US008277256B2

(12) United States Patent
Ju

(10) Patent No.: US 8,277,256 B2
(45) Date of Patent: Oct. 2, 2012

(54) ELECTRICAL CONNECTOR

(75) Inventor: Ted Ju, Keelung (TW)

(73) Assignee: Lotes Co., Ltd., Keelung (TW)

( * ) Notice: Subject to any disclaimer, the term of this patent is extended or adjusted under 35 U.S.C. 154(b) by 8 days.

(21) Appl. No.: 13/159,911

(22) Filed: Jun. 14, 2011

(65) Prior Publication Data

US 2012/0196481 A1 Aug. 2, 2012

(30) Foreign Application Priority Data

Jan. 28, 2011 (CN) ..... 2011 2 0031883 U

(51) Int. Cl.
*H01R 24/00* (2011.01)

(52) U.S. Cl. ..... 439/626

(58) Field of Classification Search ..... 439/626, 439/70, 630, 862, 71
See application file for complete search history.

(56) References Cited

U.S. PATENT DOCUMENTS 7,497,700 B2 * 3/2009 Chen et al. ..... 439/78
8,118,603 B2 * 2/2012 Ho ..... 439/70
2010/0081329 A1 * 4/2010 Fan ..... 439/626
2010/0184334 A1 * 7/2010 Ma ..... 439/626
2010/0216344 A1 * 8/2010 Fan ..... 439/626
2010/0227507 A1 * 9/2010 Cheng et al. ..... 439/626
2011/0223781 A1 * 9/2011 Ho ..... 439/70

* cited by examiner

*Primary Examiner* — Jean F Duverne
(74) *Attorney, Agent, or Firm* — Morris Manning & Martin LLP; Tim Tingkang Xia, Esq.

(57) ABSTRACT

An electrical connector includes: an insulating body, having a plurality of terminal receiving holes, in which each terminal receiving hole includes a retaining slot recessed from an upper surface of the insulating body and a receiving slot formed through the insulating body and connected with the retaining slot, and the retaining slot has a bottom surface that forms a step with a sidewall of the receiving slot; a metal layer, plated on the sidewall of the receiving slot, being not higher than the bottom surface; and a plurality of terminals, respectively y accommodated in each terminal receiving hole, in which each terminal includes a retaining portion fixed in the retaining slot, a base and a soldering portion extend downwards from the retaining portion and are suspended in the receiving slot, and a clearance is formed between the retaining portion and the metal layer for preventing a conduction therebetween.

8 Claims, 7 Drawing Sheets

ELECTRICAL CONNECTOR

CROSS-REFERENCE TO RELATED APPLICATION

This non-provisional application claims priority under 35 U.S.C. §119(a) on Patent Application No. 201120031883.4 filed in China on Jan. 28, 2011, the entire contents of which are hereby incorporated by reference.

FIELD OF THE INVENTION

The present invention relates to an electrical connector, and more particularly to an electrical connector having a shielding effect and capable of preventing a short circuit between the terminal and the shielding layer.

BACKGROUND OF THE INVENTION

Along with the rapid development of computer technology and increasingly higher requirements of products for data transmission rate, the number of terminals in an electrical connector is greatly increased, and as the density of the terminals increases, the Electromagnetic Interference (EMI) among the terminals shows a greater impact on the performance of the electrical connector. Commonly, a metal plating method is adopted in the industry to improve the interference resistance of the electrical connector. Generally, the electrical connector includes an insulating body, conductive terminals and terminal receiving holes disposed in the insulating body. The terminal receiving hole includes a retaining slot recessed from an upper surface of the insulating body and a receiving slot formed through the insulating body from top to bottom. The conductive terminal has a retaining portion accommodated in the retaining slot. A shielding layer is disposed on a sidewall of the receiving slot lower than a bottom surface of the retaining slot, and an insulating layer is disposed on the shielding layer. As the retaining portion is accommodated in the recessed retaining slot, when the shielding layer is plated on the sidewall of the terminal receiving hole, a part of the shielding layer penetrates upwards to the bottom surface of the retaining slot. Thus, the shielding layer may contact the retaining portion, which easily causes a short circuit between the conductive terminal and the shielding layer and adversely influences the signal transmission of the electrical connector.

Therefore, a heretofore unaddressed need exists in the art to address the aforementioned deficiencies and inadequacies.

SUMMARY OF THE INVENTION

In one aspect, the present invention is directed to an electrical connector, which is capable of effectively preventing a short circuit between the terminal and the shielding layer while achieving a shielding effect.

In one embodiment, an electrical connector is provided. The electrical connector includes: an insulating body, having a plurality of terminal receiving holes, in which each terminal receiving hole includes a retaining slot and a receiving slot, the retaining slot is recessed from an upper surface of the insulating body, the receiving slot is formed through the insulating body and is connected with the retaining slot, and the retaining slot has a bottom surface that forms a step with a sidewall of the receiving slot; a metal layer, plated on the sidewall of the receiving slot, in which the metal layer is not higher than the bottom surface; and a plurality of terminals, respectively correspondingly accommodated in each terminal receiving hole, in which each terminal includes a retaining portion fixed in the retaining slot, a base and a soldering portion extend downwards from the retaining portion and are suspended in the receiving slot, and a clearance is formed between the retaining portion and the metal layer, for preventing a conduction of the retaining portion and the metal layer.

Compared with the prior art, in one aspect of the present invention, in the electrical connector, the metal layer is plated on the sidewall of the receiving slot, which can shield the EMI among the terminals. As the base and the soldering portion of the terminal are suspended in the receiving slot, the terminal is not conducted with the metal layer. As the clearance is formed between the retaining portion and the metal layer, when the metal layer is spray-plated on the sidewall of the receiving slot, the clearance may accommodate a penetrating portion at a top end of the metal layer, thereby preventing a part of the metal material from extending upwards to contact the retaining portion of the terminal. Therefore, the electrical connector of the present invention can prevent a short circuit between the metal layer and the terminal while achieving the shielding effect.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment, and wherein.

LIST OF REFERENCE NUMERALS IN FIGS. 1-8

Figure 1:
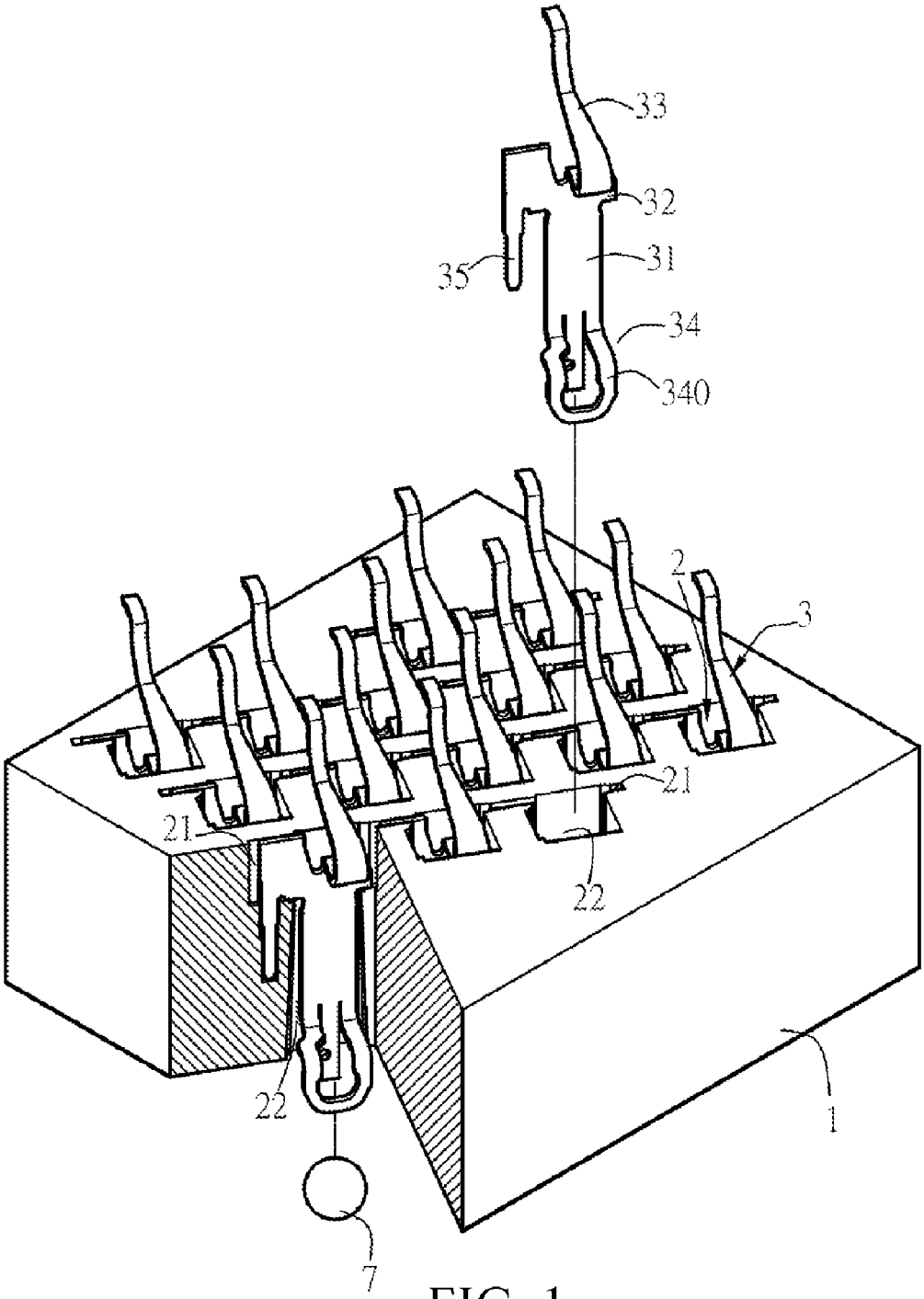
FIG. 1 is a schematic structural view of a first embodiment of the present invention.

| | | | | | |
|---|---|---|---|---|---|
| Insulating body | 1 | Terminal receiving hole | 2 | Retaining slot | 21 |
| Bottom surface | 210 | Receiving slot | 22 | Accommodating hole | 23 |
| Terminal | 3 | Base | 31 | Retaining portion | 32 |
| Contact portion | 33 | Soldering portion | 34 | Clamping arm | 340 |
| Positioning portion | 35 | Metal layer | 4 | Conductive layer | 41 |
| Insulating layer | 5, 51 | Clearance | 6 | Carrier portion | 60 |
| Recessed portion | 61 | Solder ball | 7 | | |

DETAILED DESCRIPTION OF THE INVENTION

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise.

Referring to FIG. 1, as a first embodiment of the present invention, the electrical connector includes an insulating body 1, a plurality of terminal receiving holes 2 are disposed in the insulating body 1, and each terminal receiving hole 2 correspondingly accommodates a terminal 3, and a solder ball 7 is fixed under the terminal 3.

Figure 2:
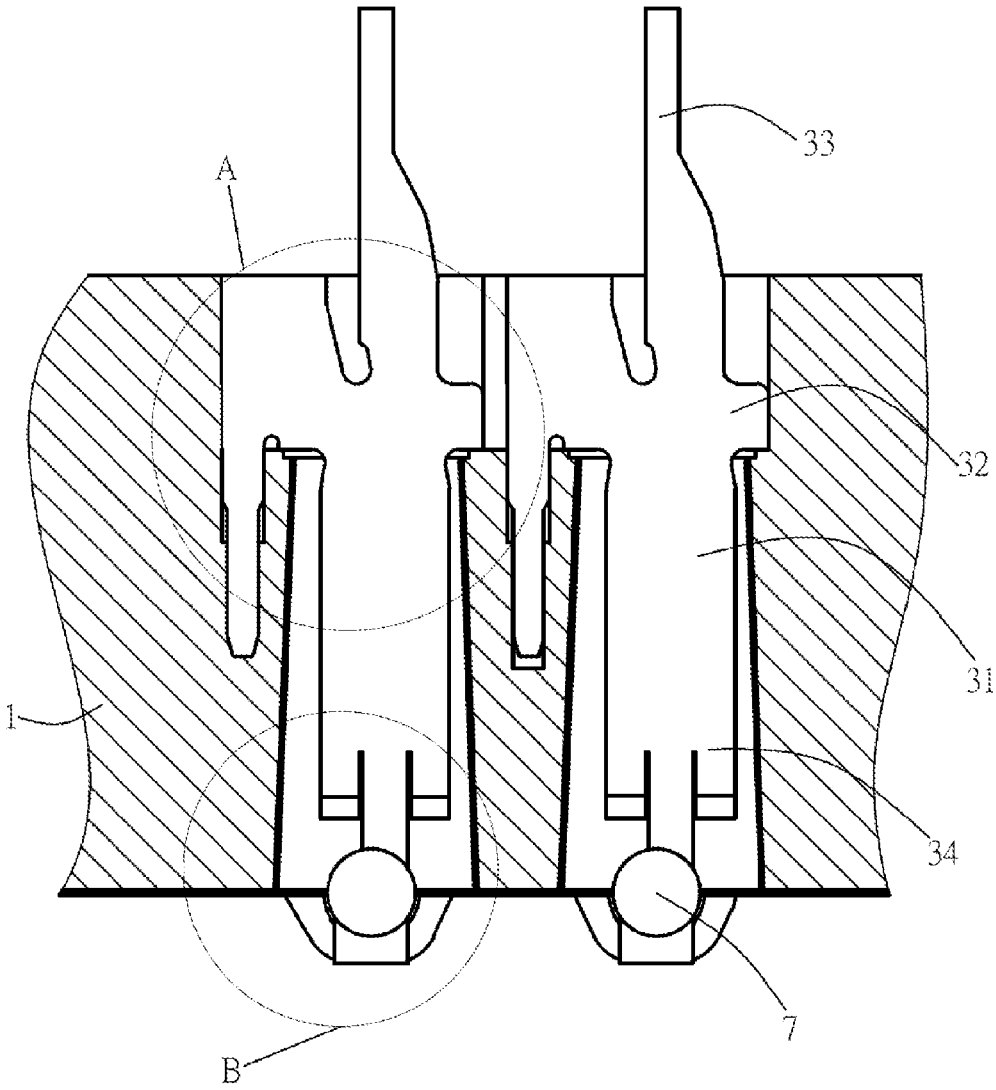
FIG. 2 is a sectional view of the first embodiment of the present invention.
Figure 3:
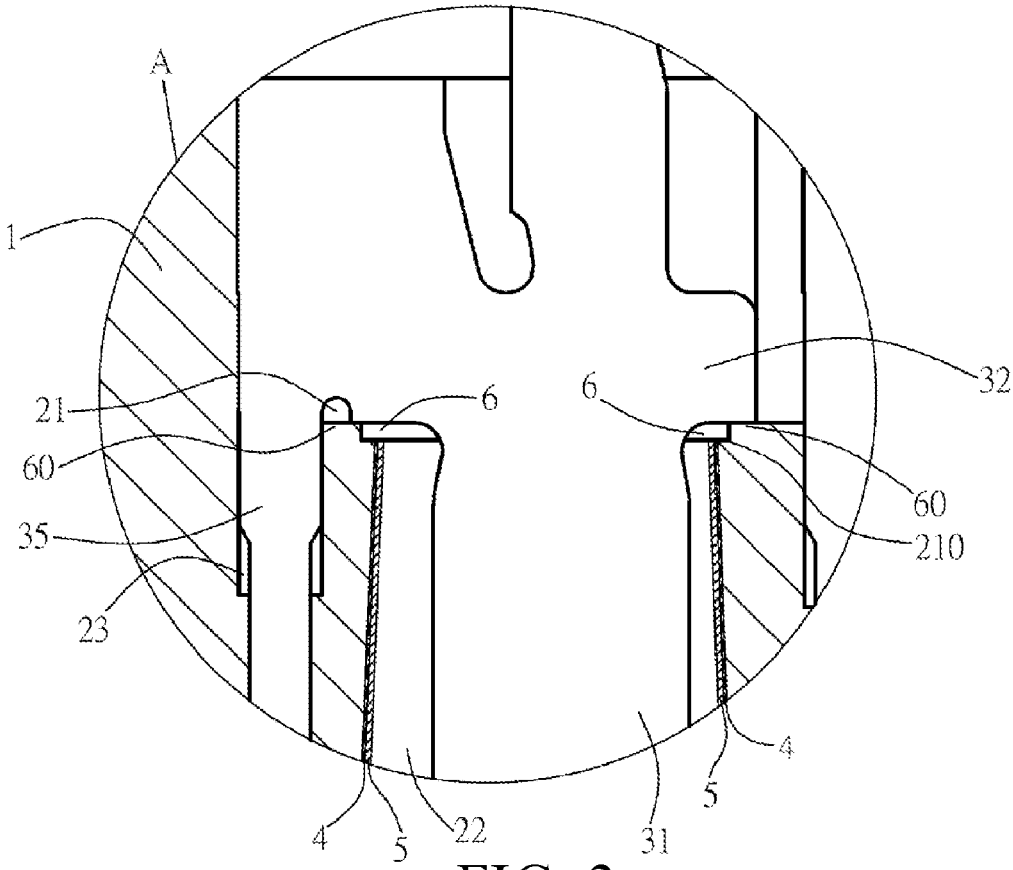
FIG. 3 is an enlarged view of Part A in FIG. 2.

Referring to FIGS. 1-3, the terminal receiving hole 2 includes a retaining slot 21 and a receiving slot 22.

The retaining slot 21 is recessed from an upper surface of the insulating body 1, and is not formed through the insulating body 1. The receiving slot 22 is located on one side of the retaining slot 21, formed through the insulating body 1 and connected with the retaining slot 21. The retaining slot 21 has a bottom surface 210 that forms a step with a sidewall of the receiving slot 22. An accommodating hole 23 is further recessed in the retaining slot 21, and the accommodating hole 23 and the receiving slot 22 are separated by the insulating body 1.

The receiving slot 22 is in a trapezoid shape with a wide lower base and a narrow upper base. A metal layer 4 is plated on the sidewall of the receiving slot 22 lower than the bottom surface 210 of the retaining slot 21, and the metal layer 4 is spray-plated on the sidewall of the receiving slot 22 by spray-plating on one side from bottom to top, so the metal layer 4 is not higher than the bottom surface 210, thereby shielding the EMI among the terminals 3. To prevent a conduction of the terminal 3 and the metal layer 4, an insulating layer 5 is formed on the metal layer 4.

Figure 4:
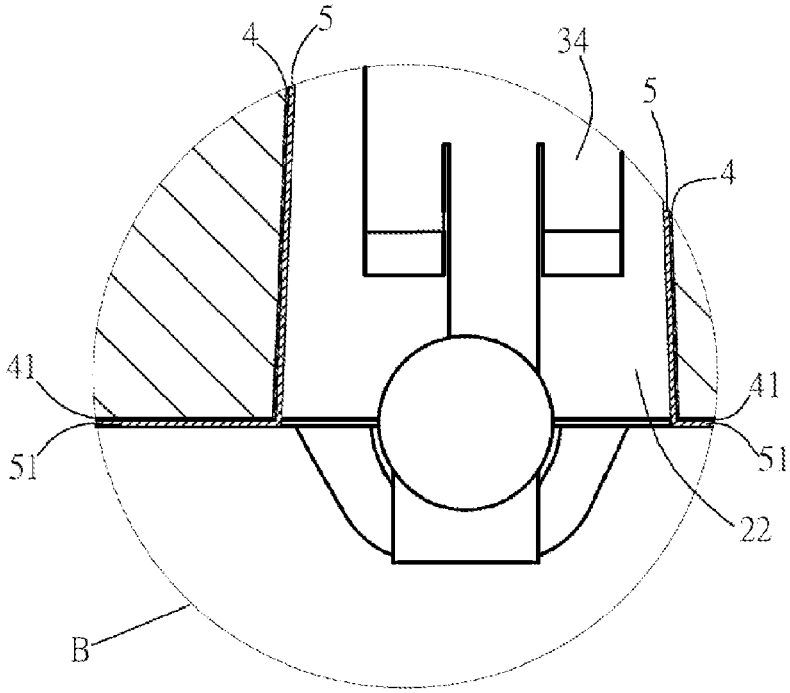
FIG. 4 is an enlarged view of Part B in FIG. 2.

Referring to FIG. 3 and FIG. 4, a conductive layer 41 is also disposed on a lower surface of the insulating body 1, and the conductive layer 41 is connected with the metal layer 4. Likewise, an insulating layer 51 is also formed on a surface of the conductive layer 41, and the insulating layer 51 is connected with the insulating layer 5.

Referring to FIG. 2 and FIG. 3, each terminal 3 has a retaining portion 32 fixed in the retaining slot 21, and a clearance 6 is formed between the retaining portion 32 and the metal layer 4, for preventing a conduction of the terminal 3 and the metal layer 4. A base 31 extends downwards from the retaining portion 32, a soldering portion 34 extends downwards from the base 31, and the soldering portion 34 has a clamping arm 340 for clamping the solder ball 7. The base 31 and the soldering portion 34 are both suspended in the receiving slot 22, and are not in contact with the metal layer 4. A contact portion 33 extends upwards from the retaining portion 32, and the contact portion 33 protrudes out of the terminal receiving hole 2. A positioning portion 35 extends laterally from the retaining portion 32, and the positioning portion 35 is accommodated in the accommodating hole 23.

In this embodiment, a carrier portion 60 protrudes on the bottom surface 210 towards the retaining portion 32. The carrier portion 60 is located on the bottom surface 210 at a position distal from the metal layer 4, and the carrier portion 60 forms another step with the bottom surface 210, so two steps are formed between the retaining slot 21 and the receiving slot 22. The retaining portion 32 presses against the carrier portion 60, and the clearance 6 is formed between the retaining portion 32, the bottom surface 210 and the metal layer 4.

Figure 5:
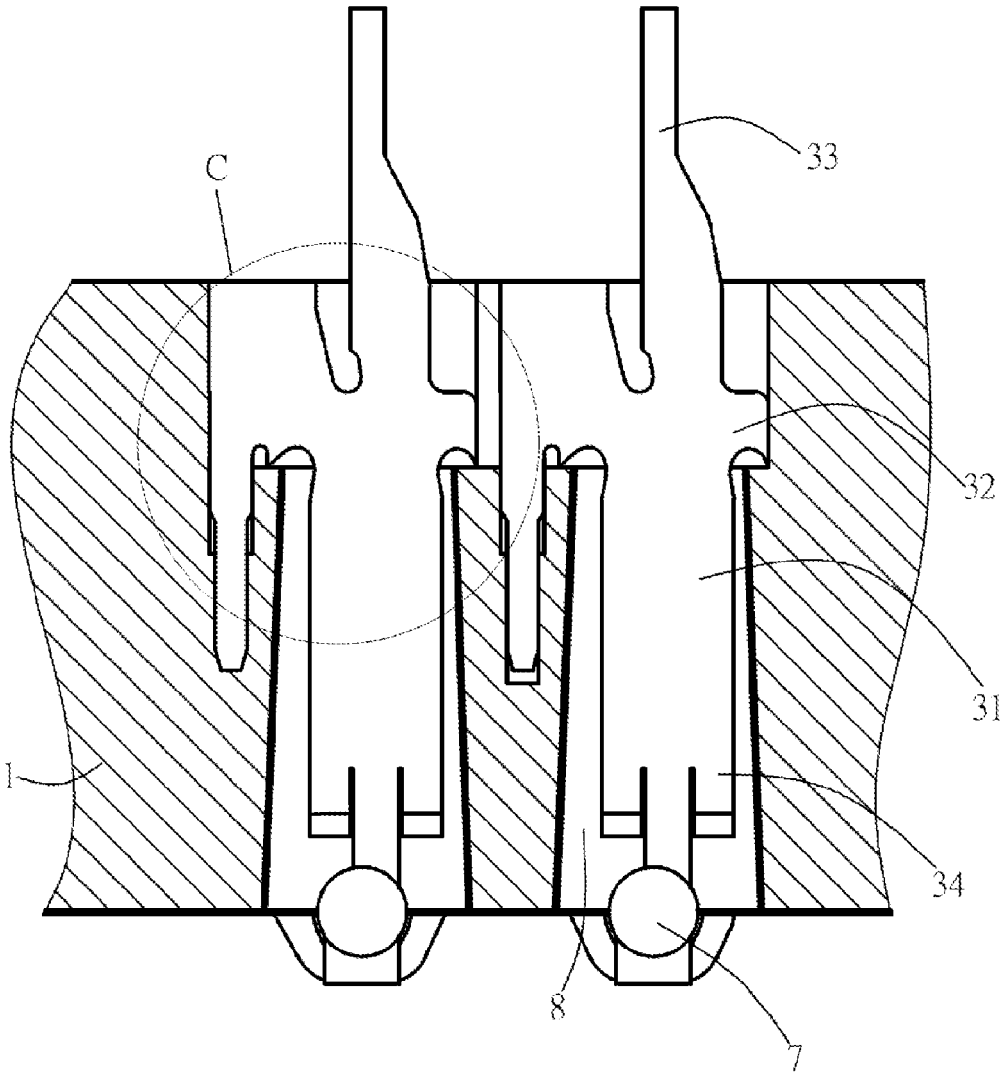
FIG. 5 is a sectional view of a second embodiment of the present invention.
Figure 6:
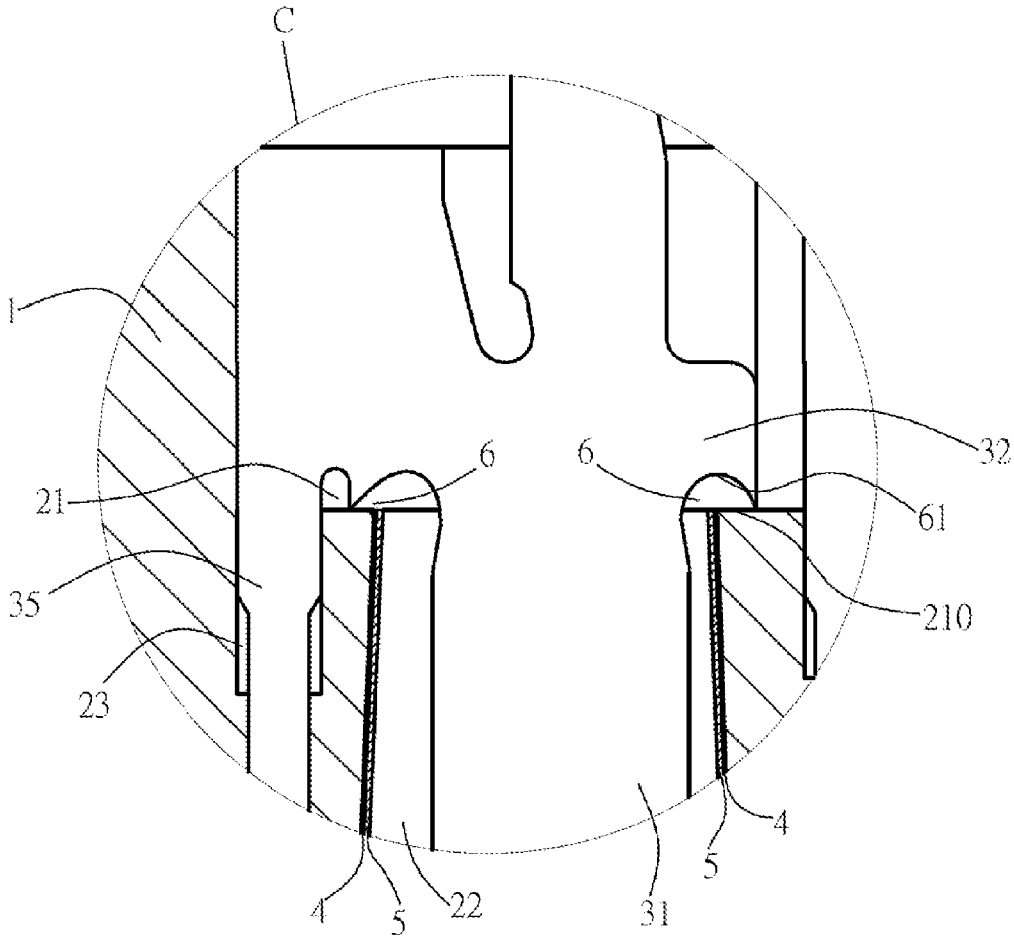
FIG. 6 is an enlarged view of Part C in FIG. 5.

FIG. 5 and FIG. 6 illustrate a second embodiment of the present invention, which has the following difference as compared with the first embodiment. A recessed portion 61 is recessed upwards at a bottom end of the retaining portion 32, and the clearance 6 is formed between the recessed portion 61, the metal layer 4 and the bottom surface 210.

Figure 7:
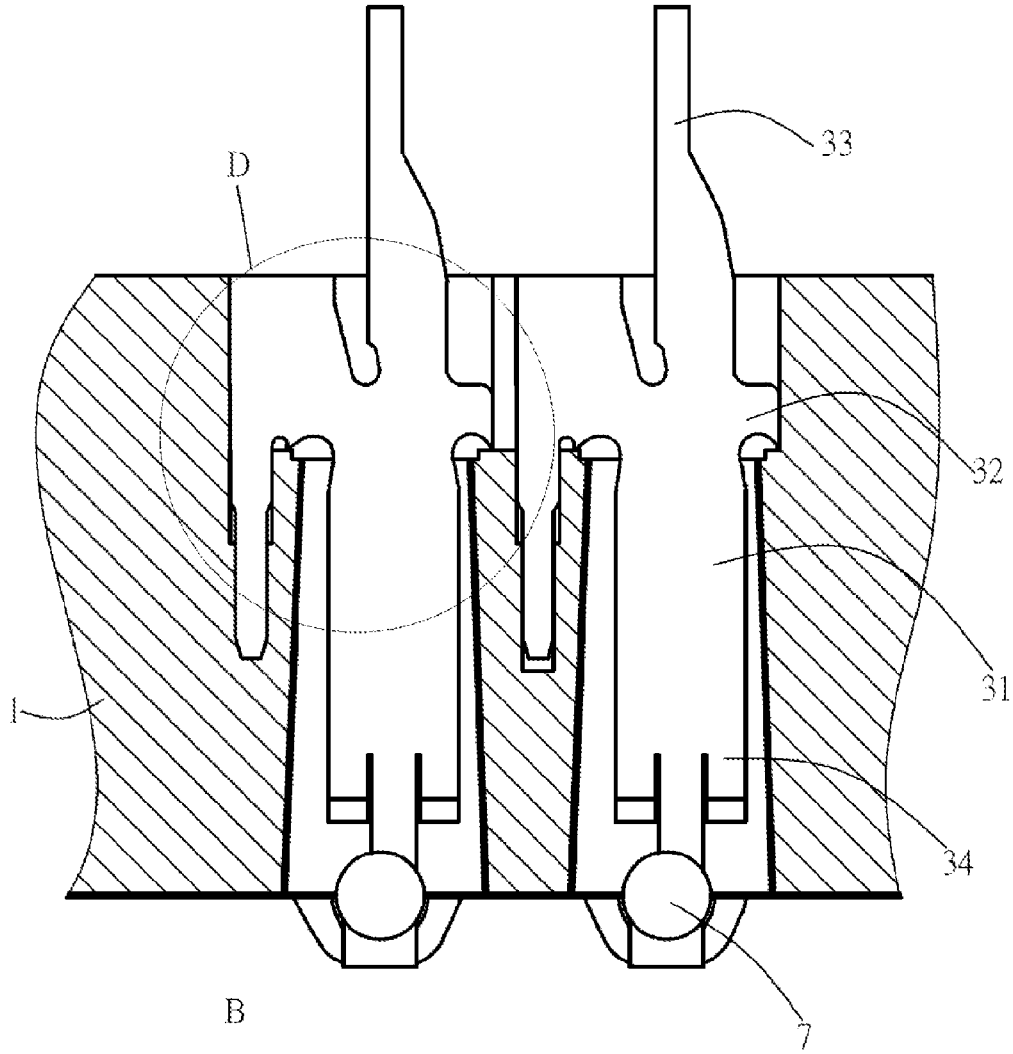
FIG. 7 is a sectional view of a third embodiment of the present invention.
Figure 8:
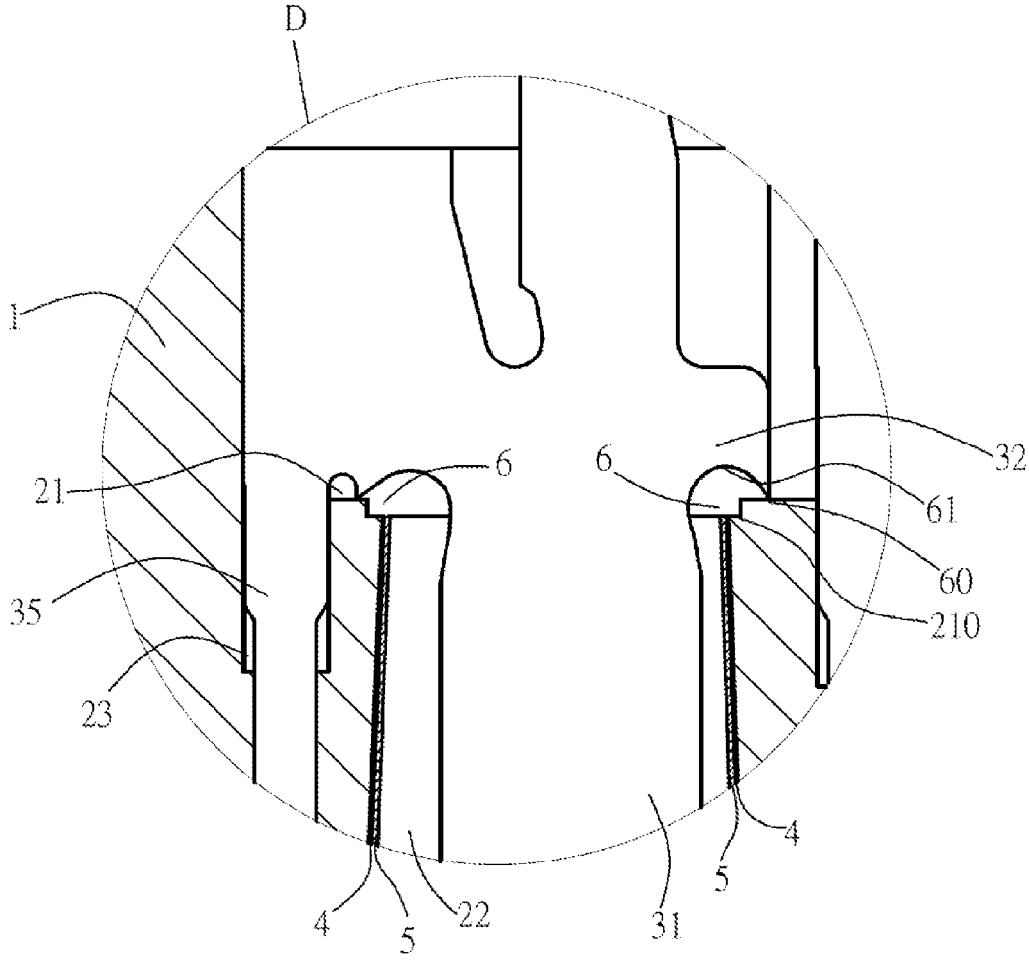
FIG. 8 is an enlarged view of Part D in FIG. 7.

FIG. 7 and FIG. 8 illustrate a third embodiment of the present invention, which incorporates the technical solutions of the first embodiment and the second embodiment. That is, a carrier portion 60 protrudes on the bottom surface 210 towards the retaining portion 32, the retaining portion 32 presses against the carrier portion 60, and meanwhile a recessed portion 61 is recessed upwards at the bottom end of the retaining portion 32.

According to one embodiment of the electrical connector of the present invention, to prevent the EMI among the terminals 3, a metal material layer may be spray-plated upwards from the lower surface of the insulating body 1. In this manner, the conductive layer 41 is formed on the lower surface of the insulating body 1 and meanwhile the metal layer 4 connected with the conductive layer 41 is formed on the sidewall of the receiving slot 22. Then, an insulating material layer is spray-plated on the surface of the metal layer 4 in the same manner, thereby forming the insulating layer 51 and the insulating layer 5 which are connected with each other. Since the receiving slot 22 is in a shape with a wide lower base and a narrow upper base, when the metal material is spray-plated from bottom to top, the metal material is not easily spray-plated in the retaining slot 21, thereby effectively preventing a short circuit between the retaining portion 32 and the top end of the metal layer 4.

The present invention, among other things, has the following beneficial effects.

1. As the metal layer 4 is plated on the sidewall of the receiving slot 22, and the base 31 and the soldering portion 34 are both suspended in the receiving slot 22 and are not in contact with the metal layer 4, the formation of the metal layer 4 by spray-plating on one side not only can reduce the cost and achieve the shielding effect, but also can prevent a short circuit between the metal layer 4 and the terminals 3.

2. As the clearance 6 is formed between the retaining portion 32 and the top end of the metal layer 4, when the metal material is spray-plated on the sidewall of the receiving slot 22, the clearance 6 may accommodate the penetrating portion at the top end of the metal layer 4, thereby preventing a part of the metal material from extending upwards to contact the retaining portion 32 of the terminal 3.

3. The insulating layers 5, 51 are covered on the surfaces of the metal layers 4, 41, thereby further effectively isolating the metal layer 4 and the terminal 3 and providing a more reliable shielding effect.

4. As the conductive layer 41 is also plated on the lower surface of the insulating body 1 and the conductive layer 41 is connected with the metal layer 4, the shielding effect of the terminal 3 in each terminal receiving hole 2 can be achieved simply by grounding the conductive layer 41, thereby omitting the elements and processes for grounding the metal layer 4 in each terminal receiving hole 2.

5. As the receiving slot 22 is in a trapezoid shape with a wide lower base and a narrow upper base, when the metal material is spray-plated from bottom to top, the metal material is not easily spray-plated in the retaining slot 21, thereby effectively preventing a short circuit between the retaining portion 32 and the metal layer 4.

6. The positioning portion 35 is disposed to position the retaining portion 32 in the retaining slot 21 more firmly and is not in contact with the metal layer 4, thereby achieving a reliable shielding effect.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, comprising:

an insulating body, having a plurality of terminal receiving holes, wherein each terminal receiving hole comprises a retaining slot and a receiving slot, the retaining slot is recessed from an upper surface of the insulating body, the receiving slot is formed through the insulating body and is connected with the retaining slot, and the retaining slot has a bottom surface that forms a step with a sidewall of the receiving slot;

a metal layer, plated on the sidewall of the receiving slot, wherein the metal layer is not higher than the bottom surface; and a plurality of terminals, respectively correspondingly accommodated in each terminal receiving hole, wherein each terminal comprises a retaining portion fixed in the retaining slot, a base and a soldering portion extend downwards from the retaining portion and are suspended in the receiving slot, and a clearance is formed between the retaining portion and the metal layer, for preventing a conduction of the retaining portion and the metal layer.

2. The electrical connector according to claim 1, wherein an insulating layer is formed on the metal layer.

3. The electrical connector according to claim 1, wherein a conductive layer is plated on a lower surface of the insulating body, and the conductive layer is connected with the metal layer.

4. The electrical connector according to claim 1, wherein a carrier portion protrudes on the bottom surface towards the retaining portion, the retaining portion presses against the carrier portion, and the clearance is formed between the retaining portion and the bottom surface.

5. The electrical connector according to claim 4, wherein the carrier portion is located on the bottom surface at a position distal from the metal layer.

6. The electrical connector according to claim 1, wherein a recessed portion is recessed upwards at a bottom end of the retaining portion, and the clearance is formed between the recessed portion, the metal layer and the bottom surface.

7. The electrical connector according to claim 1, wherein an accommodating hole is recessed in the retaining slot, and a positioning portion extends laterally from the retaining portion and is accommodated in the accommodating hole.

8. The electrical connector according to claim 1, wherein the receiving slot is in a trapezoid shape with a wide lower base and a narrow upper base.

* * * * *